US005492328A

United States Patent [19]

Lundquist

[11] Patent Number: 5,492,328

[45] Date of Patent: Feb. 20, 1996

[54] GOLF STANCE ALIGNMENT DEVICE

[76] Inventor: T. R. Lundquist, 15 Dingee Rd., South Salem, N.Y. 10590

[21] Appl. No.: 399,520

[22] Filed: Mar. 7, 1995

[51] Int. Cl.[6] ..... A63B 69/36

[52] U.S. Cl. ..... 273/187 R; 273/187 A

[58] Field of Search ..... 273/187 R, 187 A, 273/187 B, 187.1, 195 A

[56] References Cited

U.S. PATENT DOCUMENTS

| | | | |
|---|---|---|---|
| D. 225,242 | 11/1972 | Pruitt | D34/5 |
| D. 308,087 | 5/1990 | Buffey | D21/234 |
| 1,208,995 | 12/1916 | Lyon | 273/187 R |
| 1,484,390 | 2/1924 | Gibbs et al. | 273/187 A |
| 1,761,532 | 6/1930 | Morris | 273/187.1 |
| 2,025,519 | 1/1935 | Lingg | 33/174 |
| 2,150,580 | 3/1939 | Crowley | 273/187 R |
| 2,152,381 | 3/1939 | Harpster | 273/186.1 |
| 2,169,407 | 8/1939 | Crowley | 273/187 R |
| 2,180,170 | 11/1939 | Richards | 273/187 R |
| 2,457,351 | 12/1948 | Crowley | 273/187 R |
| 2,606,026 | 8/1952 | Young | 273/187 R |
| 2,652,251 | 9/1953 | Molinar | 273/187 R |
| 2,707,638 | 5/1955 | Manley | 273/187 A |
| 2,777,697 | 1/1957 | Crossot | 273/187 R |
| 2,790,642 | 4/1957 | Rolfe | 273/187 R |
| 2,941,808 | 6/1960 | Smith et al. | 273/187 R |
| 3,041,075 | 6/1962 | Taylor | 273/187 R |
| 3,166,327 | 1/1965 | Champion | 273/187 R |
| 3,229,981 | 1/1966 | Taber | 273/187 |
| 3,253,830 | 5/1966 | Laskin | 273/187 R |
| 3,343,268 | 9/1967 | Schennum | 33/174 |
| 3,429,577 | 2/1969 | Godden | 273/186.1 |
| 3,542,369 | 11/1970 | Anderson | 273/186.1 |
| 3,561,764 | 2/1971 | Thomas | 273/183 |
| 3,638,950 | 2/1972 | Hyotlaine | 273/187 R |
| 3,658,344 | 4/1972 | Kimble | 273/187 R |
| 3,784,208 | 1/1974 | Weygandt | 273/187 A |
| 3,868,109 | 2/1975 | Fowler | 273/187 A |
| 4,000,905 | 1/1977 | Shirhall | 273/187 A |
| 4,101,130 | 7/1978 | Richards | 273/187 A |
| 4,164,352 | 8/1979 | O'Brien | 273/187 A |
| 4,257,608 | 3/1981 | Funk | 273/187 R |
| 4,322,084 | 3/1982 | Reece et al. | 273/187 R |
| 4,384,718 | 5/1983 | Cachola | 273/187 R |
| 4,434,983 | 3/1984 | Taggart | 273/187 R |
| 4,538,815 | 9/1985 | Poirier | 273/187 R |
| 4,544,160 | 10/1985 | Miner | 273/192 X |
| 4,544,161 | 10/1985 | Guendling, Jr. | 273/187 A |
| 4,563,010 | 1/1986 | McDorman et al. | 273/187 |
| 4,736,952 | 4/1988 | Taft et al. | 273/187 R |
| 4,784,393 | 11/1988 | Williams et al. | 273/187 R |
| 4,805,913 | 2/1989 | Bott | 273/187 R |
| 5,071,130 | 12/1991 | Shofner | 273/187 A |
| 5,108,105 | 4/1992 | Shimizu | 273/186 R |
| 5,110,133 | 5/1992 | Durso | 273/187 R |

*Primary Examiner*—George J. Marlo

*Attorney, Agent, or Firm*—Fitzpatrick, Cella, Harper & Scinto

[57] ABSTRACT

A golf swing alignment device for aligning a golfer's left foot and right foot with respect to an intended flight path of a golf ball comprises a substantially flat mat providing a plurality of indicators. The indicators include a plurality of foot alignment indicators, parallel to one another and provided at a side of the mat intended to be placed adjacent to the golfer's feet; a path direction indicator having an extended axis parallel to the foot alignment indicators and spaced further from the golfer's feet than the foot alignment indicators; and a plurality of golf ball positioning indicators, parallel to each other and perpendicular to the path direction indicator. The golf ball positioning indicators and the path direction indicator in combination define a line on which a golf ball is to be positioned, the line being parallel to or collinear with the extended axis of the path direction indicator. A right handed golfer desiring to effect a draw of the ball places his right foot in alignment with a first one of the foot alignment indicators and places his left foot in alignment with a second one of the foot alignment indicators closer to the path direction indicator than the first foot alignment indicator. A right handed golfer desiring to effect a fade of the ball places his left foot in alignment with the first foot alignment indicator and his right foot in alignment with the second alignment indicator.

15 Claims, 4 Drawing Sheets

Fig. 2
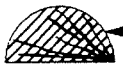
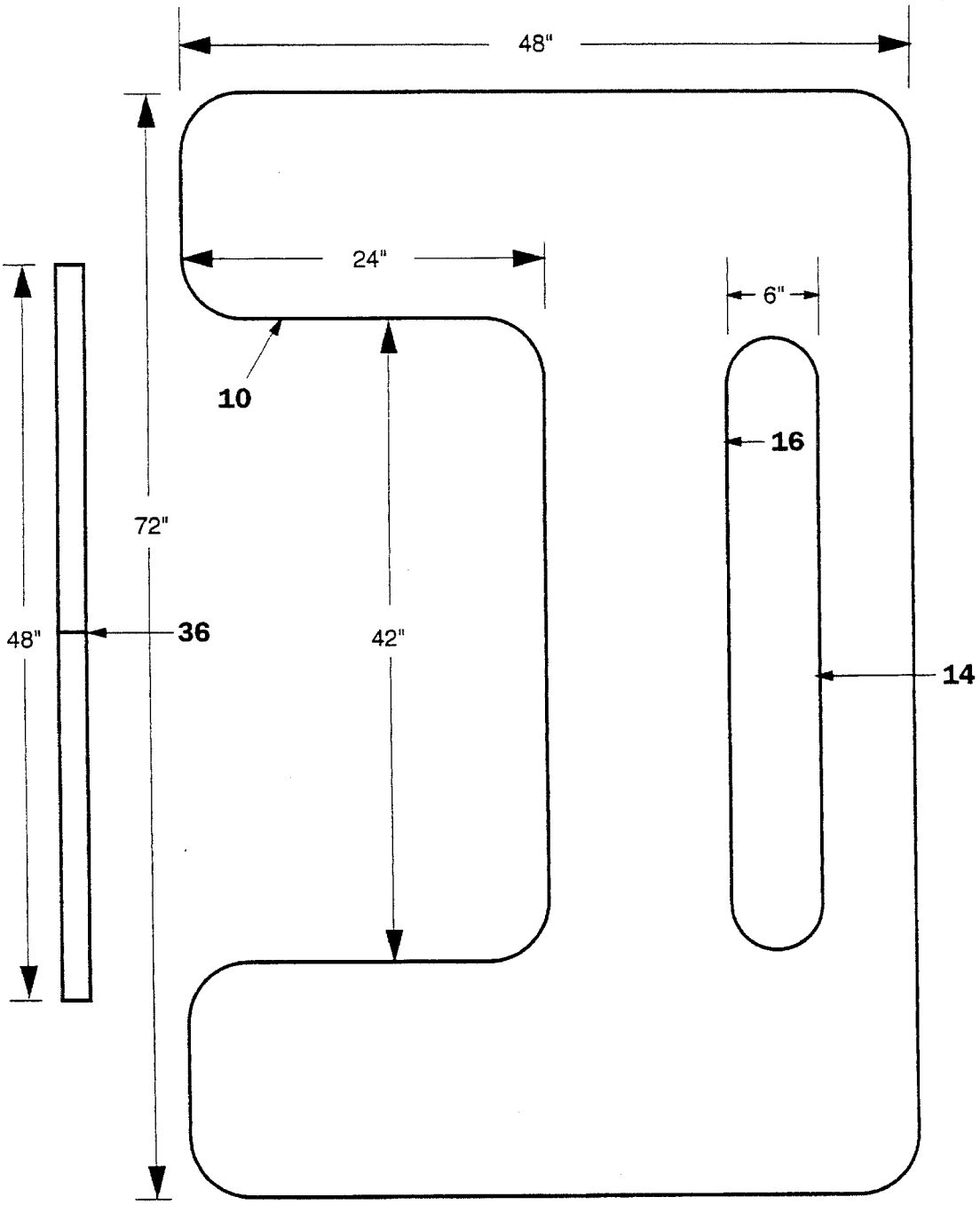
Fig. 4

GOLF STANCE ALIGNMENT DEVICE

BACKGROUND OF THE INVENTION

This invention relates to the field of golf stance alignment devices that help a golfer line up his or her feet properly with respect to-a target direction of a golf ball.

A very common problem among golfers, whether beginners or professionals, is hitting a shot aimed at a certain position only to have it end up far to the left or right of that position. The most important factor in obtaining consistently straight ball flight is proper alignment of the feet with respect to the target line of flight of the golf ball. Beginners are often so concerned with other aspects of the pre-swing routine, such as keeping their head down, maintaining the proper grip, etc., that foot alignment with respect to the target line is often ignored. Beginners may also be unaware of how to position their feet squarely, even if they try.

In addition, more advanced players often wish to hit a controlled slice (fade) or controlled hook (draw). Proper positioning of the feet is helpful in achieving these shots. However, when golfers first experiment with foot positioning aimed at producing a draw or fade, it may be difficult for them to judge how far off the squared position the feet have to be to produce a controlled fade or draw, rather than a screaming slice or "duck-hook".

SUMMARY OF THE INVENTION

It is an object of the present invention to provide a golf swing alignment device that encourages a stance that is square with respect to the intended path of the golf ball.

It is another object of the present invention to provide a golf swing alignment device that allows a golfer to shift his right or left foot in a measured manner so as to allow the golfer to effect a draw or fade of the golf ball.

It is another object of the present invention to provide a golf swing alignment device for aligning a golfer's left foot and right foot with respect to an intended flight path of a golf ball.

It is another object of the present invention to provide a golf swing alignment device that is easily stored and carried.

In accordance with these and other objects, a golf swing alignment device according to the present invention for aligning a golfer's left foot and right foot with respect to an intended flight path of a golf ball comprises a substantially flat mat providing a plurality of indicators, the indicators including: a plurality of foot alignment indicators parallel to one another, provided at a side of the mat intended to be placed adjacent to the golfer's feet, a path direction indicator (flight path indicator) having an extended axis parallel to the foot alignment indicators and spaced further from the side than the foot alignment indicators, and a plurality of golf ball positioning indicators, parallel to each other and perpendicular to the path direction indicator, the golf ball positioning indicators and the path direction indicator in combination defining a line on which a golf ball is to be positioned, the line being parallel to or coincident with the extended axis of the path direction indicator. As a result of this structure, when the golfer desires to effect a straight golf shot, he places both his left and right feet in alignment with one of the foot alignment indicators when addressing the ball. When a right handed golfer desires to effect a draw of the ball, he places his right foot in alignment with a first one of the foot alignment indicators and places his left foot in alignment with a second one of the foot alignment indicators further from his body than the first foot alignment indicator, and when a right handed golfer desires to effect a fade of the ball, he places his left foot in alignment with the first foot alignment indicator and his right foot in alignment with the second alignment indicator.

The mat is advantageously rectangular, with cut out portions so that the golfer's feet and the golf ball rest directly on the grass, rather than on the mat itself, to simulate actual playing conditions. In addition, a stance guide in the form of a rod may be used to improve the precision of foot positioning.

These and other objects and advantages of the present invention may be understood by reference to the following detailed description taken together with the attached drawings.

BRIEF DESCRIPTION OF THE DRAWINGS

FIG. 2 is a side cross-sectional view of the stance guide of FIG. 1;

FIG. 4 is a schematic top view of the mat and stance guide of FIG. 1, but devoid of indicia.

DETAILED DESCRIPTION OF THE PREFERRED EMBODIMENT

Figure 1:
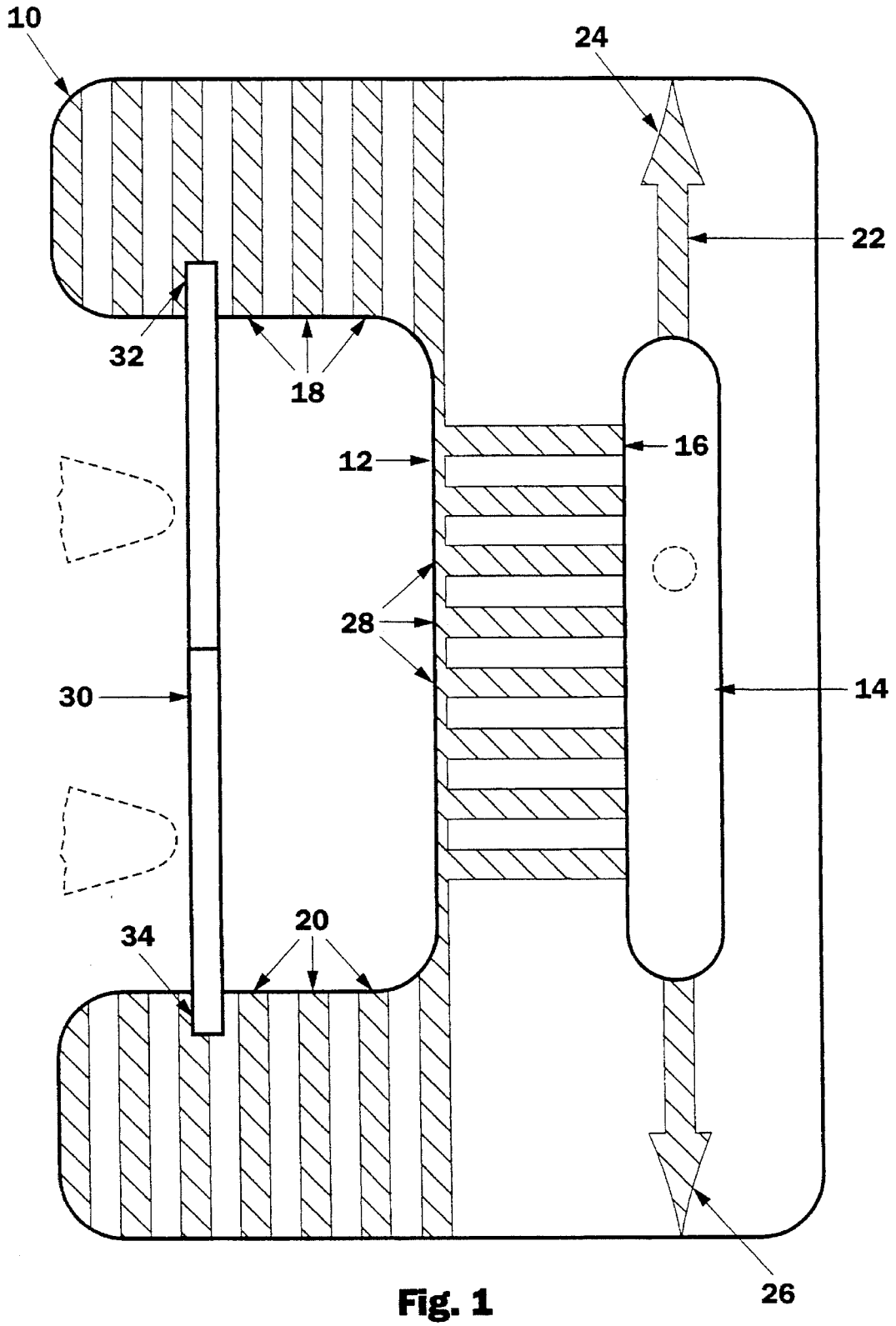
FIG. 1 is a top plan view of a device in accordance with a first embodiment of the present invention.

FIG. 1 shows the device in a first preferred embodiment. The device consists of a substantially flat mat 10, preferably made of vinyl or some other thin, flexible sturdy material, which is generally rectangular with rounded corners. In this embodiment, the mat 10 is intended to be placed on the grass or cleared ground on a golf course, lawn or the like. Accordingly, to enable the golfer to have a steady footing that replicates the conditions he will experience on the golf course itself, the perimeter of the mat 10 includes an indent 12 defining a smaller, generally rectangular portion cut out at the left side of the mat 10 as illustrated in FIG. 1. The golfer stands with his feet on the grass within the indent 12, as shown by the dotted outline. Similarly, to replicate actual playing conditions as much as possible, an elongated interior channel 14 of the mat 10 defined by an edge 16 is cut out to allow the golf ball (shown in dotted outline) to be placed directly on the grass which will protrude through the channel 14 from below, or to allow a tee to be inserted into the ground. The channel 14 is long enough and wide enough to allow the golf ball to be placed in any position within a desired range and to avoid any interference with the swing and the struck golf ball.

Imprinted on the mat 10 are a series of parallel left foot position indicator lines 18 which act as a visual check for the golfer to position the toe of his left foot. Also imprinted on the mat 10 are a series right foot position indicator lines 20 for achieving the same result with respect to the golfer's right foot. Each of these and the other indicators on the mat 10 is advantageously printed thereon in a contrasting color. Of course, the indicators may be produced by another method, such as embossing, or may be attached to the mat.

Flight path indicator 22 is a double headed arrow imprinted across the mat 10 opposite the golfer in line with and parallel to the long axis of channel 14. Flight path indicator 22 is also parallel with the foot indicator lines 18, 20, and indicates the direction of flight of the golf ball when the golfer assumes a square stance and hits the golf ball perfectly straight. Accordingly, the two arrow heads 24, 26 may be used as guides for properly orienting the mat 10 with respect to the target. In particular, a right handed golfer can orient the arrow head 24 at the target while standing in the indent 12 in the orientation shown in FIG. 1, while a left handed golfer can turn the mat 10 180° and use the other arrow head 26 to orient the mat 10. This allows the mat 10 to be used by either left or right handed golfers.

Ball placement indicating lines 28, perpendicular to the flight path indicator 22, allow the golfer to quantify the position of the golf ball in the stance.

In addition to mat 10, the device according to the present invention advantageously includes a stance guide 30 that is made out of a half-round wooden dowel (FIG. 2) of a length which allows it to be placed over the indent 12 with ends 32, 34 resting on opposing portions of the mat 10. Advantageously, the stance guide 30 is made in two halves (FIG. 3) joined at 36 by a hinge to enable the stance guide 30 to be folded in half for easy storage and transport. Alternatively, the stance guide may be formed such that the end of one half is fitted with a plastic or rubber piece which allows the other half to be fitted snugly therein during use while allowing the two halves to be separated for easy storage when not in use.

In fact, both the mat 10 and the stance guide 30 are designed for easy storage and transport in a conventional golf bag. Advantageously, the mat 10 and the stance guide 30 have the dimensions shown in FIG. 4, and the mat 10 is preferably made of vinyl. Accordingly, the mat 10 can be folded or rolled up and the stance guide 30 can be folded or disassembled to 24" in length allowing it to fit easily within conventional golf bags which average approximately 35" in height.

The use of the device will be described with reference to FIGS. 1 and 3. First the golfer places the mat 10 on the ground with the appropriate arrow head 24, 26 pointed at a desired point in the distance. Next, the golfer places the ball on the grass within the channel 14. The ball can be placed more or less forward, left or right depending upon whether the golfer is right or left handed, using the ball placement indicating lines 28 to give the golfer a reference point for the next shot. With practice, the golfer will find the ideal location at which to place the ball for all clubs and types of shots. The following discussion will assume that the golfer is right handed, although it will be clear how the use is modified for a left handed player.

The golfer then addresses the ball with the club of his choice. Looking down at his feet, the golfer takes the stance guide 30 and places it just in front of the toe of his front (left) foot, parallel to the arrow head 24 and overlapping the mat 10 at both ends, as indicated in FIG. 1. The left and right foot position indicator lines 18, 20 allow the golfer to make sure that the stance guide 30 is parallel to the arrow head 24, with the shading pattern aiding in exact positioning. The choice of how far from the ball to place the stance guide 30 will depend on the choice of the club and the size of the golfer.

The golfer again addresses the ball by placing the toe of his other foot against the edge of the stance guide 30, as in FIG. 1, thus allowing him to be sure that his feet are squared up to the point at which he is aiming.

Figure 3:
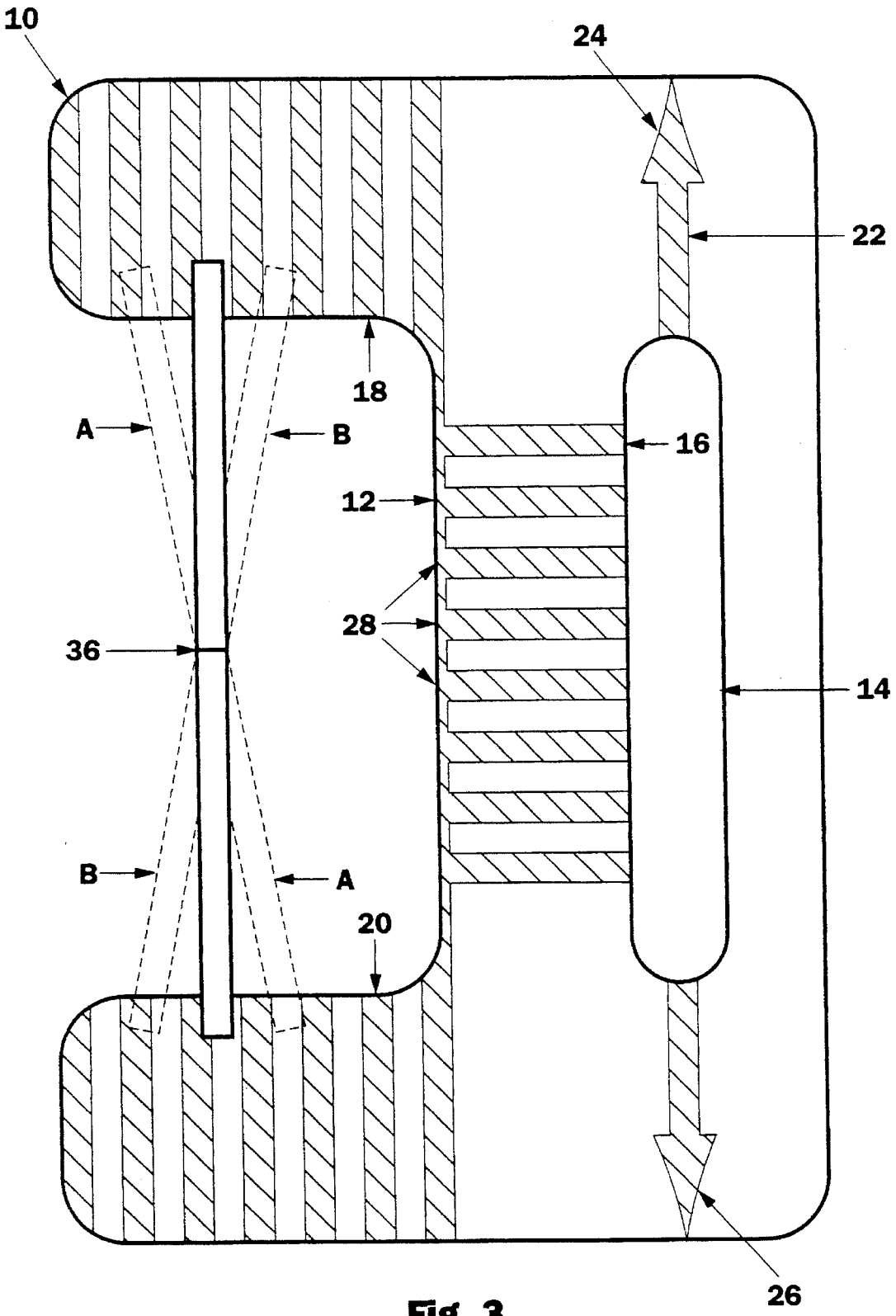
FIG. 3 is a top plan view of the device in accordance with the first embodiment of the present invention.

Turning the stance guide 30 counterclockwise, to position A in FIG. 3, and moving his feet to accommodate this move, will cause a right handed golfer to hit a fade (a shot that will travel from left to right). Turning the stance guide 30 clockwise, to position B in FIG. 3, and moving his feet to accommodate this move will cause a right handed golfer to hit a draw shot (a shot that will travel from right to left).

Figure 5:
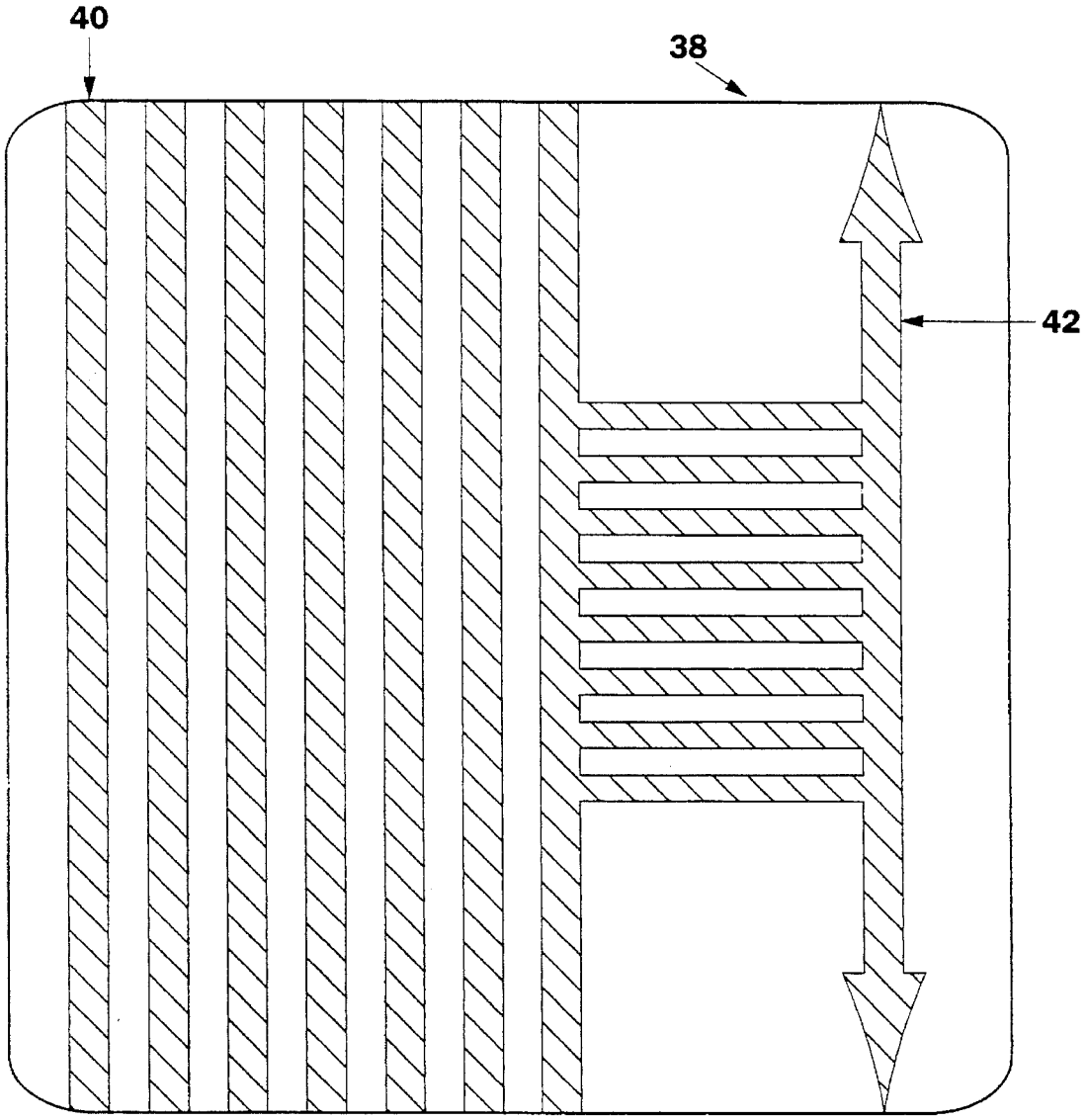
FIG. 5 is a top plan view of a device in accordance with a second embodiment of the present invention.

In the first embodiment discussed above, the device is intended to be used on a grass surface. In a second embodiment, illustrated in FIG. 5, the device in accordance with the present invention is intended to be used as a driving range mat. At most driving ranges, the ground consists of concrete, so there is no reason to have a cut out portion for the feet or ball. In this embodiment, therefore, the mat 38 is without cut outs and the left and right foot indicators join together to form continuous foot indicators 40. This reduces the need for the stance guide 30, although it may still be employed for greatest precision. The Flight path indicator may also become a continuous, two headed arrow 42. In this embodiment, the mat 38 may be made of artificial grass with the indicia discussed above being printed directly thereon. In addition, the mat 38 may generally be thicker to provide for wear resistant use at the driving range.

As described above, the device according to the present invention provides self-explanatory, easy-to-use indicators for helping the golfer to improve his stance. As is well known, repeated practice of the desired physical movement enables the golfer to internalize the mental and physical sensations to the point where the correct stance will just "feel right" and is assumed without conscious deliberation. This is turn frees the golfer's mind to focus on other aspects of his swing.

While the present invention has been described above in connection with two preferred embodiments, it will be apparent that many changes may be made without departing from the scope of the invention. For example, the mat may have square corners instead of rounded corners. The mat may have a cut out for the golfer's feet without one for the ball, or vice versa. The cut out for the ball may be an indent rather than an interior portion, and the cut out for the feet may be an interior portion rather than an indent. A mat intended for a driving range may be made of a more rigid material, if it is not intended to be moved frequently. In addition, a mat intended for a driving range may have a cut out portion to allow for variable placement of a rubber tee. The stance guide may be made of plastic, metal or any other suitable material, it may have a different cross-section and it may be made in one piece. The stance guide may be omitted, with the golfer using only the foot indicators in either embodiment. Since these and other changes are considered to be within the scope of the invention, the scope should be interpreted by reference to the appended claims.

What is claimed is:

1. A golf swing alignment device for aligning a golfer's left foot and right foot with respect to an intended flight path of a golf ball, said device comprising a substantially flat mat providing a plurality of indicators, said indicators including:

a plurality of right foot alignment indicators and a plurality of opposing left foot alignment indicators collinear with one another and provided at a side of said mat intended to be placed adjacent to the golfer's feet said mat having an edge at said side defining an indent between said right and left foot alignment indicators large enough to accommodate the golfer's feet at positions indicated by said right and left foot alignment indicators;

a path direction indicator having an extended axis parallel to said foot alignment indicators and spaced further from said side than said foot alignment indicators; and a plurality of golf ball positioning indicators, defining a direction for golf ball positions that extends perpendicular to said path direction indicator, said golf ball positioning indicators and said path direction indicator in combination defining a line extending along said direction on which a golf ball is to be positioned, said line being parallel to or collinear with said extended axis of said path direction indicator, whereby:

when the golfer desires to effect a straight golf shot, he places both his left and right feet in alignment with one of said foot alignment indicators when addressing the ball, when a right handed golfer desires to effect a draw of the ball, he places his right foot in alignment with a first one of said foot alignment indicators and places his left foot in alignment with a second one of said foot alignment indicators closer to the path direction indicator than said first foot alignment indicator, and when a right handed golfer desires to effect a fade of the ball, he places his left foot in alignment with said first foot alignment indicator and his right foot in alignment with said second alignment indicator.

2. A device according to claim 1, wherein said line is collinear with said path direction indicator.

3. A device according to claim 1, wherein said path direction indicator is in the form of a double headed arrow parallel to said foot alignment indicators.

4. A device according to claim 1, wherein said path direction indicator is in the form of first and second arrows parallel to said foot alignment indicators.

5. A device according to claim 4, wherein said mat has a cut out in which a golf ball may be positioned encompassing a portion of said line adjacent said golf ball positioning indicators and between said first and second arrows.

6. A device according to claim 5, wherein said cut out is located between said first and second arrows.

7. A device according to claim 1, further comprising an elongated stance indicator movable across said mat indicate a desired foot position in correspondence with said foot alignment indicators.

8. A device according to claim 7, wherein said stance indicator is a separate rod.

9. A device according to claim 7, wherein said rod is foldable lengthwise.

10. A device according to claim 1, wherein said mat is foldable.

11. A device according to claim 1, wherein said mat is rollable.

12. A device according to claim 1, wherein each of said indicators includes a straight line printed on said mat.

13. A device according to claim 1, wherein said mat is generally rectangular.

14. A golf swing alignment device for aligning a golfer's left foot and right foot with respect to an intended flight path of a golf ball, said device comprising:

a substantially rectangular mat having an edge closer to the golfer and an edge further from the golfer, and having a rectangular indent area, centrally located on the edge closer to the golfer, in which the golfer places his feet when addressing the ball and further having:

a plurality of left foot alignment indicia, substantially parallel to one another and with the intended flight path, said left foot alignment indicia being provided on a left side of the mat, with respect to the golfer, on a side closer to the golfer, a plurality of right foot alignment indicia, substantially parallel to one another and with the intended flight path, each right foot indicia being collinear with a corresponding one of the plurality of left foot alignment indicia, a double arrow-headed path direction indicator, running parallel to the edge of the mat further from the golfer, having a channel cut out between the arrowheads for allowing underlying grass to protrude therethrough, a plurality of golf ball positioning indicia, parallel to each other and oriented perpendicularly to said left and right foot alignment indicia, said golf ball positioning indicia being provided on a side of the mat opposite that of the golfer, wherein:

when the golfer desires to effect a straight golf shot, the golfer places each of his left and right feet at corresponding collinear left and right foot alignment indicators when addressing the ball;

when the golfer desires to effect a draw or fade for a left-handed golfer, of the golf ball, the golfer places his right foot in alignment with one of the right foot alignment indicators closer to his body than the left foot alignment indicator at which he is placing his left foot; and when the golfer desires to fade or draw for a left-handed golfer, the golf ball, the golfer positions his left foot at a position corresponding to a left foot alignment indicia closer to his body than the right foot alignment indicia at which he is placing his right foot.

15. A golf swing alignment device as according to claim 14, further comprising:

a rigid foot position indicator, semicircular in cross-section for placing onto the mat to connect any one of said left foot alignment indicia with any one of said right foot alignment indicia, said rigid foot position indicator being placed on the mat to ensure that the golfer's feet remain at a selected alignment with respect to said left and right foot alignment indicia.

* * * * *